US007621161B2

(12) United States Patent
Fontana et al.

(10) Patent No.: US 7,621,161 B2
(45) Date of Patent: Nov. 24, 2009

(54) MAGNETIC SYSTEM FOR THE UNLOCKING OF PADLOCKS AND LOCKS

(76) Inventors: Fabio Fontana, Via Enrico Stevenson, 11, Rome (IT) 00162; Massimo Fontana, Via Enrico Stevenson, 11, Rome (IT) 00162

( * ) Notice: Subject to any disclaimer, the term of this patent is extended or adjusted under 35 U.S.C. 154(b) by 0 days.

(21) Appl. No.: 11/909,554

(22) PCT Filed: Mar. 23, 2006

(86) PCT No.: PCT/IT2006/000180

§ 371 (c)(1),
(2), (4) Date: Sep. 24, 2007

(87) PCT Pub. No.: WO2006/100708

PCT Pub. Date: Sep. 28, 2006

(65) Prior Publication Data

US 2008/0190152 A1 Aug. 14, 2008

(30) Foreign Application Priority Data

Mar. 24, 2005 (IT) ..... RM2005A0143

(51) Int. Cl.
*E05B 17/14* (2006.01)
*E05B 47/00* (2006.01)

(52) U.S. Cl. ..... 70/276; 70/413; 70/424; 70/428; 70/455

(58) Field of Classification Search ..... 70/276, 70/413, 423–428, 455
See application file for complete search history.

(56) References Cited

U.S. PATENT DOCUMENTS

| | | | | | |
|---|---|---|---|---|---|
| 3,380,268 | A * | 4/1968 | Perrill | 70/491 |
| 3,477,261 | A * | 11/1969 | Siana | 70/427 |
| 3,602,020 | A * | 8/1971 | Kajita | 70/276 |
| 3,837,195 | A * | 9/1974 | Pelto | 70/276 |
| 3,967,479 | A * | 7/1976 | Vick | 70/276 |
| 4,022,038 | A * | 5/1977 | Miller | 70/276 |
| 4,285,220 | A * | 8/1981 | Kajita | 70/276 |
| 5,819,569 | A * | 10/1998 | Herdman | 70/420 |
| 6,397,647 | B1 * | 6/2002 | Kuo | 70/423 |
| 6,550,298 | B1 * | 4/2003 | Su | 70/276 |
| 2003/0066321 | A1 | 4/2003 | Su | |
| 2007/0113605 | A1 * | 5/2007 | Lopez | 70/276 |

FOREIGN PATENT DOCUMENTS

| | | | |
|---|---|---|---|
| DE | 19500846 | A1 | 7/1996 |
| DE | 29619390 | U1 | 3/1997 |
| DE | 20103571 | U1 | 6/2001 |
| EP | 1088951 | A | 4/2001 |
| EP | 1422364 | A | 5/2004 |
| FR | 2677069 | | 12/1992 |

* cited by examiner

*Primary Examiner*—Lloyd A Gall
(74) *Attorney, Agent, or Firm*—Gauthier & Connors LLP

(57) ABSTRACT

A magnetic system for the unlocking of padlocks and locks including, a lock-cover element which together with a component fixed to a fitting allows or disallows access to a keyhole. A unlocking-key element which has the function of blocking or unblocking the lock-cover element.

11 Claims, 2 Drawing Sheets

MAGNETIC SYSTEM FOR THE UNLOCKING OF PADLOCKS AND LOCKS

PRIORITY INFORMATION

This application is a continuation of International Patent Application No. PCT/IT06/000180 filed on Mar. 23, 2006 which claims benefit of Italian Patent Application No. RM2005A000143, filed on Mar. 24, 2005, all of which are incorporated herein in their entirety.

BACKGROUND OF THE INVENTION

1. Field of the Invention

This industrial invention patent regards a magnetic system which when placed within padlock and lock mechanisms allows these mechanisms to be blocked or unblocked at the discretion of the user.

In particular this device includes a magnetic system which by use of a device protected by a personalized code can either permit or prevent the movement of a mechanism to which it is applied.

2. Brief Description of the Art

This industrial invention patent constitutes an innovation in the field of common unlocking systems for padlocks and locks and in particular for those used for doors. Reference to this type of use will later be made but this will only be done for example purposes since the same principles are applicable for other applications (for example safes and locking devices in general).

With current technology magnetic unlocking systems for padlocks and locks are composed of devices that include magnetic components in the key. These keys can pose a serious health risk to patients with internal medical devices that are sensitive to magnets such as pace makers. Furthermore transporting such keys together with credit cards or cards with magnetic stripes can alter the magnetic properties of both the keys and the cards.

The device being presented for this industrial invention patent develops current systems in that the device only contains magnetic components in the mechanism of the padlock or lock applied to the fitting and not in the keys body.

SUMMARY OF THE INVENTION

Consequently the specific object in question of this industrial invention patent is a magnetic system for the unlocking of padlocks and locks characterized by the fact that it includes:

- one or more fixed base elements;
- one or more magnet sensitive plates which are inserted in the fixed base element;
- one or more overlying elements that can be made to move; pairs of pins made of magnet material and of varying length which either
- prevent or permit the movement of the base and overlying elements; screws that have the function of keeping the fixed base elements fastened to the overlying elements;
- means for unlocking that are made from material that is either magnet sensitive or magnet insensitive and that according to predetermined and personalized codes either attract or leave the pairs of magnets immobile;
- components that assemble the unlocking means and that maintain the personalized code constant; and
- aesthetic and mechanical trimmings aimed at distinguishing the system and to make it suitable for general use with all commercially available padlocks and locks.

BRIEF DESCRIPTION OF THE DRAWINGS

The invention will now be described in an illustrative but not limited manner as being part of an already generally known device for covering padlocks and locks but it must be understood that this only has the aim of making the clearer the presentation description and enunciation. The design patent will now be illustrated in its preferred but not exhaustive design form with particular attention being paid to the attached drawings in which.

DETAILED DESCRIPTION OF THE INVENTION

Figure 4:
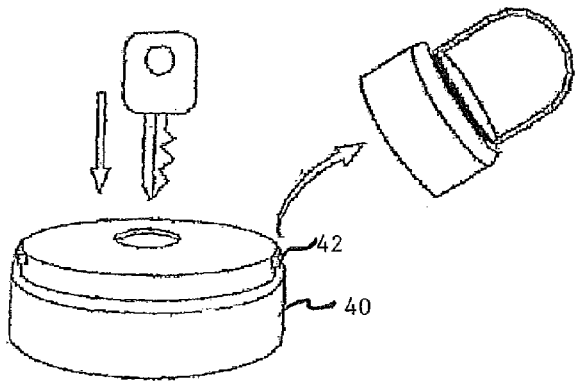
FIG. 4 is a perspective view of the magnetic system for the unlocking of padlocks and locks when in the configuration that favors access to the underlying lock.

The preferred design form of the industrial invention patent will now be described in detail. As illustrated in FIGS. 1-4, the magnetic system for the unlocking of padlocks and locks (10) is composed of:

A lock-cover element (11). The lock-cover element (11) has several sub-components which are:

- a covering element (13) at the top of which there exists a depression for the insertion of a key and on the inside of which there are holes into which magnets may be inserted; one or more gear tooth elements (13/A) in order to allow the lock-cover element (11) to either be freed from or to remain blocked with respect to the device to which it is applied this device itself already being patented such that when the corresponding fixing teeth are aligned with the gear tooth elements the indentations align with the shoulders 42 on the base, show in FIG. 4, the lock portion is removable. The unlocking steps are specified below;
- one or more overlying magnetic pins (14) having either a long measurement (14/A) or a short measurement (14/B). The function of the magnetic pin measurements is that of whether either being attracted or remaining immobile of bringing their mating surfaces to the same level as those of the surface levels of the covering element (13) and of the plate element (15), so as to allow the rotation of the covering element (13) with respect to the plate element (15) and hence facilitate the rotation and the unblocking of the gear tooth elements (13/A);
- a plate element (15) having a magnet sensitive base platelet (15/A) fixing-teeth (15/B) and sockets into which can be inserted magnets that have the function of blocking or unblocking the covering element (13); and
- a screw element (16) which has the function of holding together the lock-cover (11).
- an unlocking-key element (12). The unlocking-key element (12) consists of several sub elements which are:
- a clip element (17) for positioning and turning the unlocking-key element (12);
- a key-body element (18) having holes into which the coding-pins (20) are inserted;
- a friction-ring element made from plastic (19)
- one or more coding-pin elements (20) made from either magnet sensitive (20/C) or magnet insensitive (20/D)

material such that they can attract or leave immobile the magnetic-pin elements (14) and in so doing align them with the covering (13) and plate (15) element levels so as to allow for the rotation and unblocking of the lock-cover (11) and hence facilitate the insertion of the key into the underlying lock given that when in a state of rest the pairs of magnets are attracted to the base platelet element (15/A) the sequence of events that takes place when the unlocking-key element (12) is brought near the depression situated on the top of the lock-cover element (11) is as follows:

The magnet sensitive (20/C) coding-pins (20) located in the key-body (18) attract the magnet pairs located in the holes on the internal surface of the covering element (13) and the plate element (15) thus moving the mating surface of the magnet pairs to the same level as that of the covering element (13) and of the plate element (15) surfaces while the magnet insensitive (20/D) coding-pins (20) leave immobile the pairs of magnets on the inside of the lock-cover (11), the mating surfaces these already being at the same level as those of the covering element (13) and plate element (15) surfaces.

Figure 1:
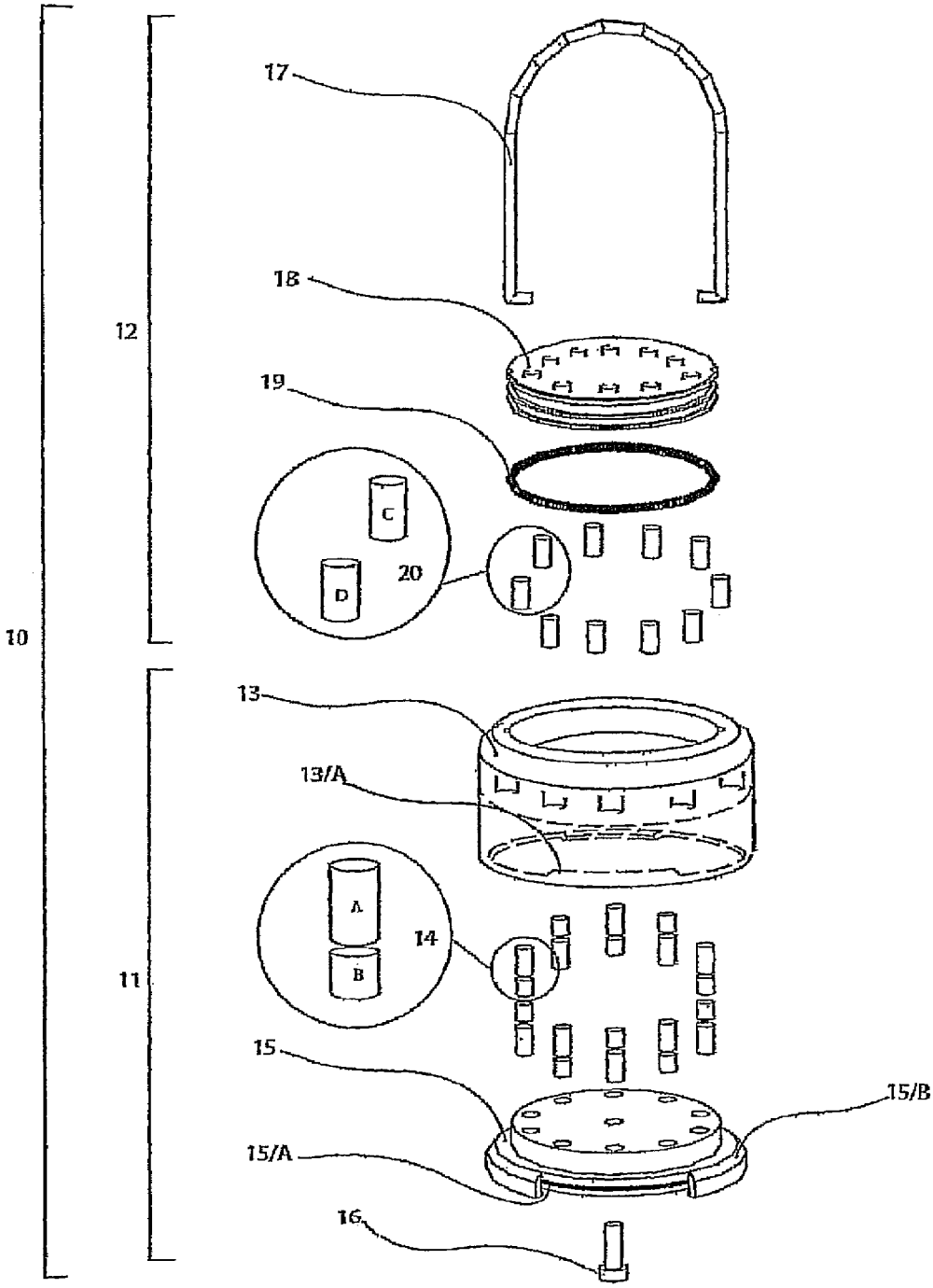
FIG. 1 is a perspective view of the disassembled magnetic system for the unlocking of padlocks and locks.
Figure 2:
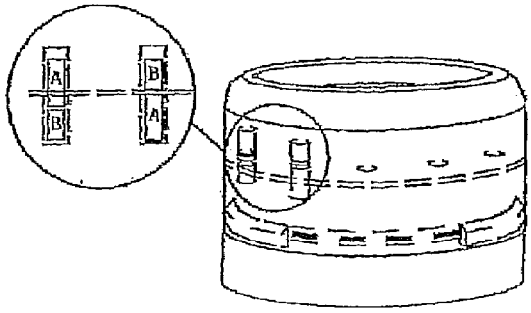
FIG. 2 is a perspective view of the magnetic system for the unlocking of padlocks and locks when in the blocked configuration.
Figure 3:
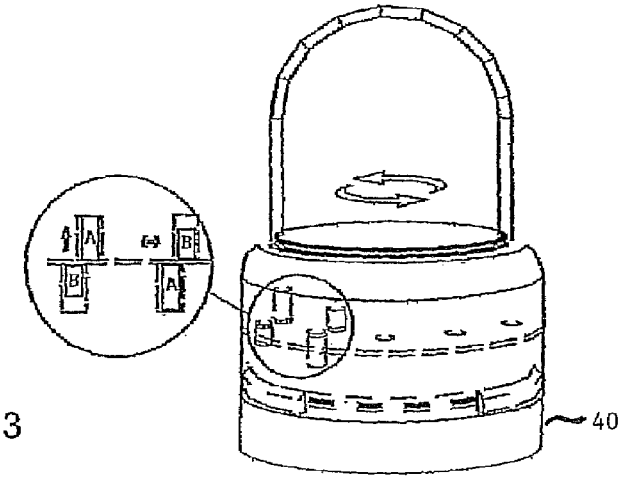
FIG. 3 is a perspective view of the magnetic system for the unlocking of padlocks and locks when in the rotation and unblocking configuration.

The sequence of necessary operations for gaining access to the underlying lock is as follows:

place the unlocking-key (12) into the depression on the top of the lock-cover element (11) as illustrated in FIG. 3, rotate the lock-cover element (11) anti-clockwise as illustrated in FIG. 3, remove the lock-cover element (11) so as to facilitate the insert pin of the subsequent key into a lock (not shown but it is located below where the key is entering) which includes a fitting 40 as illustrated in FIG. 4.

This invention has been described in an illustrative but nevertheless not a limited manner according to its preferred design form but it must be understood that any variations and/or modifications may be made without leaving the relative ambit of protection as defined in the attached claims.

We claim:

1. A magnetic system for attaching to padlocks and locks, for unlocking the same, comprising a lock-cover element, and an unlocking-key element, said lock-cover element, alternately permitting and preventing access to a lock keyhole and a fitting, said unlocking-key element alternately blocking or unblocking said lock-cover element, said system being characterised in that said lock-cover element comprises a covering element, providing one or more gear-tooth elements allowing rotation of the covering element with respect to a plate element, said plate element providing one or more tooth elements for fixing the same to the fitting, said covering element providing a plurality of holes, said plate element providing a plurality of holes, in number corresponding to the number of holes provided in said covering element, one or more magnetic pin elements, of two different length, respectively long and short, inserted in said plurality of holes of said plate element, said magnetic pin elements being attracted toward the fitting by the metal of the same fitting or by a base platelet of said plate element, and in that said unlocking-key element comprises a clip element for its positioning and rotation, a key-body element provided with holes, and one or more coding-pin elements, comprised of magnet sensitive material or magnet insensitive material, in such a way to, depending on the relative position between said unlocking-key element and said lock-cover element, attract or not said magnetic pin elements.

2. A magnetic system according to claim 1, wherein said lock-cover element further comprises a screw holding together the parts of said lock-cover element.

3. The magnetic system according to claim 1, wherein the lower surface of said covering element and the upper surface of the plate element are provided with one or more holes for the insertion and movement of said magnetic pin elements.

4. The magnetic system according to claim 1, wherein said magnetic pin elements when coupled and thus caused to be either attracted or left in a rest condition and with their mating surface at the same level of the surfaces respectively of the covering element and of the plate element permit the rotation of the covering element with respect to the plate element thus promoting the rotation and unlocking of said gear tooth elements with respect to the fitting of the lock.

5. The magnetic system according to claim 1, wherein said unlocking-key element comprises a friction-ring element made up of plastic material.

6. The magnetic system according to claim 1, wherein at least one element is comprised of base metals, alloys, plastics or other materials.

7. The magnetic system according to claim 1, wherein said covering element one, two or "n" gear-tooth elements, said gear-tooth elements having shapes, sizes, various arrangements and orientation, symmetries, asymmetries or dissimilarities according to specific use.

8. The magnetic system according to claim 1, wherein at least one element is subjected to thermal hardening techniques, which includes carbonitring, carburization, and tempering.

9. The magnetic system according to claim 1, wherein said system is employed for mechanical, electromechanical, electric, electronic, and door locks, and in that it is provided during the manufacturing of the lock, or it is retro-fitted, and in that it is placed over or interposed on said locks.

10. The magnetic system according to claim 1, wherein the magnetic system protects a keyhole, or it is used for other applications, or it is used as an independent locking device for separate metallic surfaces, for available door locks or as a new door lock or part thereof.

11. The magnetic system according to claim 1, wherein said unlocking-key element has a cylindrical shape or a different shape.

* * * * *